US005927624A

United States Patent [19]

Hughes

[11] Patent Number: 5,927,624

[45] Date of Patent: Jul. 27, 1999

[54] COMMINUTING CHAMBER AND ATTACHMENTS THEREFOR

[75] Inventor: John H. Hughes, Montesano, Wash.

[73] Assignee: ComCorp, Inc., Montesano, Wash.

[21] Appl. No.: 08/919,402

[22] Filed: Aug. 28, 1997

[51] Int. Cl.[6] ..... B02C 13/286

[52] U.S. Cl. ..... 241/69; 241/186.4

[58] Field of Search ..... 241/69, 186.4, 241/101.761, 291, 224, 166

[56] References Cited

U.S. PATENT DOCUMENTS

| | | |
|---|---|---|
| 617,523 | 1/1899 | Day . |
| 1,324,389 | 12/1919 | Ekola . |
| 1,736,563 | 11/1929 | Wilmot . |
| 1,903,526 | 4/1933 | Andrews . |
| 2,012,602 | 8/1935 | Forrester . |
| 2,033,123 | 3/1936 | Cowles . |
| 2,045,691 | 6/1936 | Armstrong . |
| 2,620,138 | 12/1952 | Vazieux et al. . |
| 2,796,807 | 6/1957 | Sanford . |
| 2,865,572 | 12/1958 | Lannert . |
| 3,037,540 | 6/1962 | Bloomquist et al. . |
| 3,143,303 | 8/1964 | Palyi . |
| 3,314,617 | 4/1967 | Sargood . |
| 3,319,897 | 5/1967 | Craig et al. . |
| 3,528,617 | 9/1970 | Trevathan . |
| 3,615,059 | 10/1971 | Moeller . |
| 3,713,595 | 1/1973 | Craig et al. . |
| 3,741,104 | 6/1973 | Kannegiesser . |
| 3,823,633 | 7/1974 | Ross . |
| 3,936,005 | 2/1976 | Schnell . |
| 3,955,765 | 5/1976 | Gaitten . |
| 3,964,716 | 6/1976 | McCorkle et al. . |
| 4,106,706 | 8/1978 | Burrows ..... 241/101.761 |
| 4,120,460 | 10/1978 | Bacher . |
| 4,243,183 | 1/1981 | Eirich et al. . |
| 4,267,982 | 5/1981 | Hooper . |
| 4,325,516 | 4/1982 | Ismar . |
| 4,366,928 | 1/1983 | Hughes . |
| 4,448,361 | 5/1984 | Marcy . |
| 4,454,995 | 6/1984 | Bloomquist . |
| 4,516,732 | 5/1985 | Kela et al. . |

(List continued on next page.)

FOREIGN PATENT DOCUMENTS

| | | |
|---|---|---|
| 121751 | 10/1984 | European Pat. Off. . |
| 1151302 | 4/1985 | U.S.S.R. . |
| 2122480 | 6/1982 | United Kingdom . |

OTHER PUBLICATIONS

Photograph of a comminuter implement in the bottom of a comminuter sold by Universal Refiner Corporation before Aug. 28, 1997.

*Primary Examiner*—Mark Rosenbaum

*Attorney, Agent, or Firm*—Christensen O'Connor Johnson & Kindness PLLC

[57] ABSTRACT

A comminuting chamber (24) and attachments therefor for comminuting solid material into a particulate form is disclosed. The chamber includes a rotatable sidewall (40), a bottom (41) disposed across an end of the sidewall, and a toothed disk (32) rotatably mounted within the chamber adjacent the bottom. At least one attachment (28) is secured to the bottom of the chamber and provides a variety of surfaces which engage and reorient material being comminuted in the chamber. The attachment may include a plate (30) that extends horizontally in a plane adjacent the bottom. An edge of the plate may further have a flange (80) that extends outward and downward toward the chamber bottom. The attachment may also include a rotary scrubber (38) having a hub (56) and a plurality of arms (58) extending radially outward from the hub. The scrubber is either rotatably mounted on the plate or on the chamber bottom. Where the attachment includes a plate, riser plate members (88) extending upward into the chamber may be attached to the plate. The plate may also include upward-extending scraper plates (92) adjacent the comminuting chamber sidewall for scraping material that has collected on the chamber sidewall as the sidewall rotates. By engaging and reorienting the material being comminuted in the chamber, the attachment surfaces improve the efficiency of the comminuter.

25 Claims, 9 Drawing Sheet

U.S. PATENT DOCUMENTS 4,583,415 4/1986 Locker .
4,593,861 6/1986 Blakely et al. .
4,657,192 4/1987 Browning .
4,664,320 5/1987 Steffens .
4,699,326 10/1987 Warren .
4,736,781 4/1988 Morey et al. .
4,767,069 8/1988 Kim .
4,773,601 9/1988 Urich et al. .
4,790,489 12/1988 Paul .
4,846,411 7/1989 Herron et al. .
4,934,615 6/1990 Osborne .
4,997,135 3/1991 Zehr .
5,379,951 1/1995 Hughes .
5,570,849 11/1996 Anderson ..... 241/101.761 s

COMMINUTING CHAMBER AND ATTACHMENTS THEREFOR

FIELD OF THE INVENTION

The invention relates to comminuters, and more specifically to comminuter chambers and attachments therefor for use in reducing solid material to a particulate form.

BACKGROUND OF THE INVENTION

In many industries there exists a need to reduce large pieces of solid material to a particulate form. For instance, in managing wood and tree waste, it is desirable to grind stumps and wood scraps into wood chips. Wood chips are more easily and efficiently transported, stored, and used for various purposes. In other instances, it is desirable to reduce large pieces of waste material, such as plastic, for recycling or disposal. Comminuters of various size and operation are generally available for performing this function.

A particular style of comminuter presently available, sometimes referred to as a pan and disk refiner, includes a comminuting chamber defined by a rotating sidewall and a bottom disposed across an end of the sidewall. U.S. Pat. No. 5,379,951, commonly assigned to the assignee of the present invention, discloses a comminuter of this style and is expressly incorporated herein by reference. Inside the comminuting chamber, a toothed disk is rotatably mounted at the bottom in a plane spaced above the bottom. Operators of the comminuter introduce material to be comminuted into the chamber where it engages the toothed disk and is reduced to particulate form.

The comminuter operates by rotating both the chamber sidewall and the toothed disk, usually in opposite directions. The rotation of the sidewall imparts rotational motion to the material placed in the chamber. As the material in the chamber rotates with the chamber sidewall, the material comes into contact with the rotating toothed disk. The teeth on the disk impact the material and thereby rip and tear the material into successively smaller pieces. The comminuting chamber typically further has a screened exit through which the material, once comminuted to a particular size, may pass out of the chamber.

During the comminuting process, material sometimes falls flat on the bottom of the chamber and avoids further contact with the rotating toothed disk. If a screened exit is also located on the chamber bottom and the material is not small enough to pass through the screen, the material may clog up the screen and prevent material that is comminuted to a sufficiently small size from exiting the comminuting chamber. Operation either continues at a lower production level, or the operator of the comminuter may need to turn the comminuter off and reorient the material in the comminuting chamber so that all of the material may properly engage the disk and to clear the screen.

Another disadvantage with present comminuters is jamming of the comminuting chamber. On occasion, a large chunk of material may lodge between the toothed disk and the sidewall, causing the comminuting chamber to jam. A comminuting chamber is particularly susceptible to violent jamming when the toothed disk and the sidewall are rotating in the same direction. Usually, if the comminuter operator is vigilant, such a jam may be remedied by reversing the rotation of the disk. However, in some instances, it may be necessary to turn the comminuter off and manually dislodge the jammed material.

Another problem inherent with present comminuters is the collection of material adhering to the chamber sidewall.

Tree stumps introduced into a comminuting chamber may carry soil into the chamber which may collect on the chamber sidewall. Material that is wet also tends to collect on the chamber sidewall. Debris that adheres to the chamber sidewall increases the weight of the sidewall, thereby demanding increased power from the comminuter to continue sidewall rotation. The debris may also hold material to be comminuted above the toothed disc and discharge screen. The efficiency of the comminuter is accordingly diminished.

A partial solution to these problems was provided in a prior comminuter developed by the present inventor and sold by Universal Refiner Corp. A comminuter of the type disclosed in U.S. Pat. No. 5,379,951 was provided with a rotary, star-shaped screen scrubber. This conventional scrubber has a center hub journaled to the stationary bottom wall of the comminuter chamber, adjacent the annular screened exit. The scrubber included a plurality of radial arms that projected only partially, i.e., about a third of the way, across the width of the screen to agitate comminuted material passing the scrubber. However, the scrubber left a substantial portion of the screen unscrubbed, reducing effectiveness.

The present invention is designed to provide solutions to these problems.

SUMMARY OF THE INVENTION

The present invention provides a comminuting chamber and attachments therefor for comminuting solid material into a particulate form. The chamber includes a rotatable sidewall, a bottom disposed across an end of the sidewall, and a toothed disk rotatably mounted within the chamber adjacent the bottom.

The comminuting chamber further includes at least one attachment secured to the bottom of the chamber. The attachment provides a variety of surfaces which engage and reorient material being comminuted in the chamber. In one embodiment, the attachment is a plate secured to the bottom of the chamber. The plate extends horizontally in a plane adjacent the bottom such that an edge of the plate engages and reorients the material. An edge of the plate may further have a flange that extends outward and downward toward the chamber bottom.

The attachment may further include a scrubber rotatably journaled on the plate. The scrubber has a hub and a plurality of arms extending radially outward from the hub. This mounting results in the scrubber being cantilevered over the screen, to cover substantially the entire width of the screen. Alternatively, the scrubber may be rotatably journaled on the chamber bottom. The arms of the thusly mounted scrubber are of a predetermined length sufficient to span substantially the entire width of the screen. The arms of the scrubber may also include barbs extending upward into the chamber. The scrubber freely rotates as material being comminuted in the chamber engages and passes by the arms of the scrubber. Alternately, the scrubber rotation could be powered by a drive mechanism such as a compact gas, hydraulic or electric motor.

Where the attachment includes a plate, riser plate members extending upward into the chamber may be attached to the plate. The riser plate members preferably have an angled edge that guides the material being comminuted in an upward direction as it passes over the riser plate members. The plate may be shaped such that the riser plate members are in close proximity to the rotating toothed disk, so that the riser plate members cause material being comminuted to travel upward and onto the rotating toothed disk. In this manner, the riser plate members help prevent material from lodging between the toothed disk and the chamber sidewall and thereby causing violent jamming of the comminuter.

In yet another embodiment of the chamber attachment, a plate secured to the chamber bottom has an edge disposed near the chamber sidewall from which one or more scraper plates projecting upward from the plate are attached. As the sidewall rotates past the scraper plates, the scraper plates scrape material that has collected on the chamber sidewall.

Alone or in combination, the various embodiments of a comminuting chamber and attachments therefor disclosed herein provide a variety of surfaces which engage and reorient material being comminuted in the chamber. The material is thus reoriented for more efficient comminuting.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
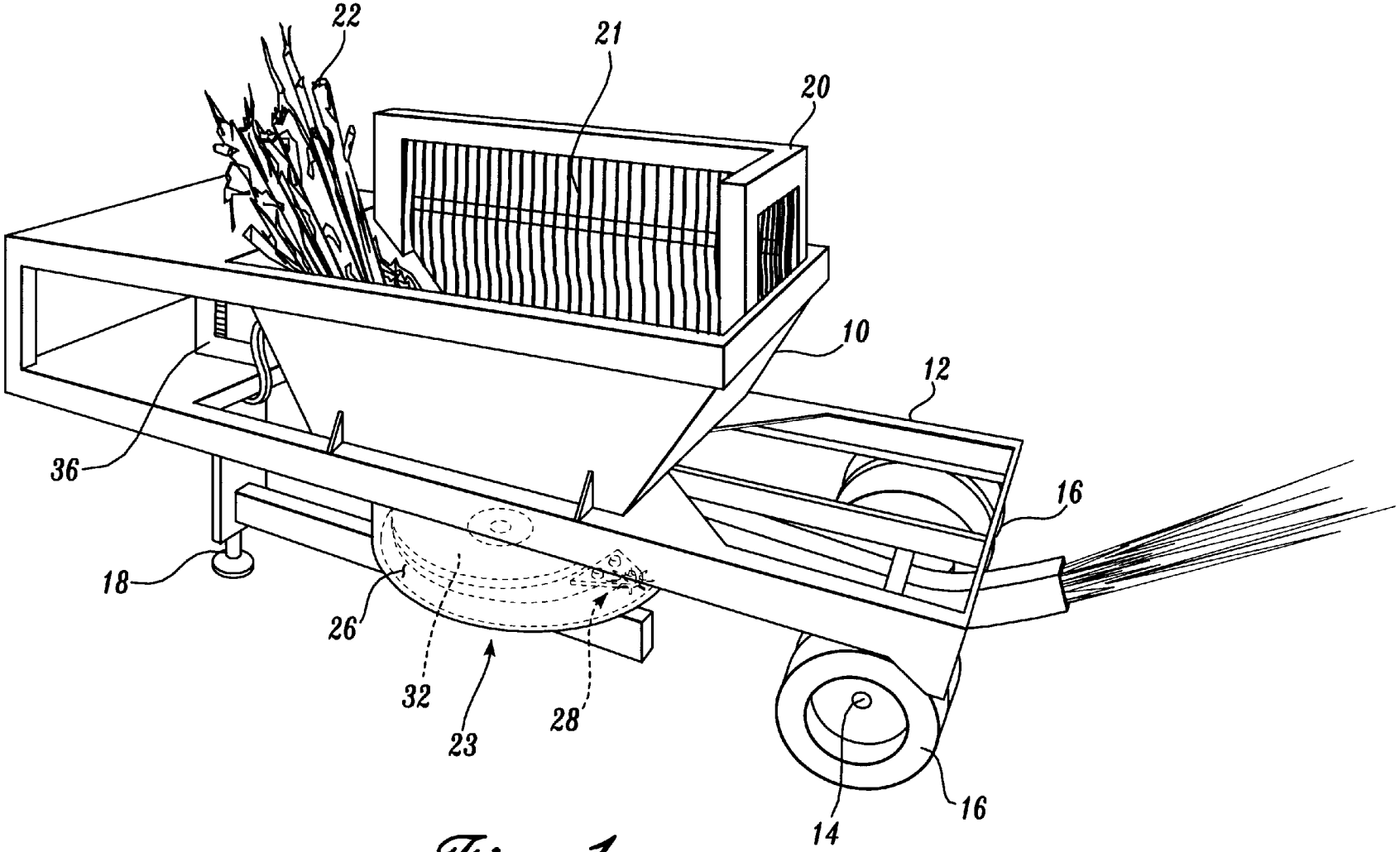
FIG. 1 is a perspective view of a comminuter with a comminuting chamber and a first embodiment of a scrubber attachment therefor constructed in accordance with the present invention.

FIG. 1 illustrates a comminuter with a chamber and a chamber attachment made in accordance with the principles of the present invention. The comminuter includes a hopper 10 mounted on a frame 12. Preferably, the frame 12 is mounted on an axle 14 with wheels 16, thereby allowing the frame 12 to be hauled from one site to another. The frame 12 also has adjustable jack legs 18 mounted at its front end for maintaining the frame in a level position. A curtain assembly constructed of a frame 20 and a plurality of chains 21 hanging vertically from the frame 20 may be mounted atop the hopper 10 to diminish the amount of material that may be thrown out of the hopper during operation of the comminuter. Alternately, solid shrouding can be used in place of the chains.

As illustrated, material to be comminuted may consist of various wood scraps 22 or stumps, plastic material, or other solid materials to be reduced. Scraps 22 fed into the hopper 10 are guided into a comminuting tub 23 mounted on the frame below the hopper. The comminuting tub 23 has a cylindrical shape, and includes an outer cylindrical housing 26. Inside the tub 23, a rotatably mounted toothed disk 32 provides comminuting action to the comminuter. The comminuter operates by rotating both an inner sidewall 40 (see FIG. 2) and the toothed disk 32. Mechanisms for rotating the sidewall and the toothed disk are known in the art and may include belt drives, gears, friction tires, or chain drives (not shown) that are powered by a power source such as a diesel engine 36. The diesel engine 36 may also provide power for hydraulic motors (not shown) to drive one or both of the sidewall and toothed disk. A suitable arrangement for driving the sidewall and toothed disk is shown and described in U.S. Pat. No. 5,379,951, incorporated by reference herein.

FIG. 1 also illustrates (in phantom line) a first preferred embodiment of a chamber attachment 28 constructed in accordance with the invention. The attachment 28 illustrated includes a mounting plate and a scrubber rotatably engaged with the mounting plate, as described in greater detail below. The attachment is disposed within the comminuting chamber to engage and reorient material 22 that is being comminuted during the operation of the comminuter.

Figure 2:
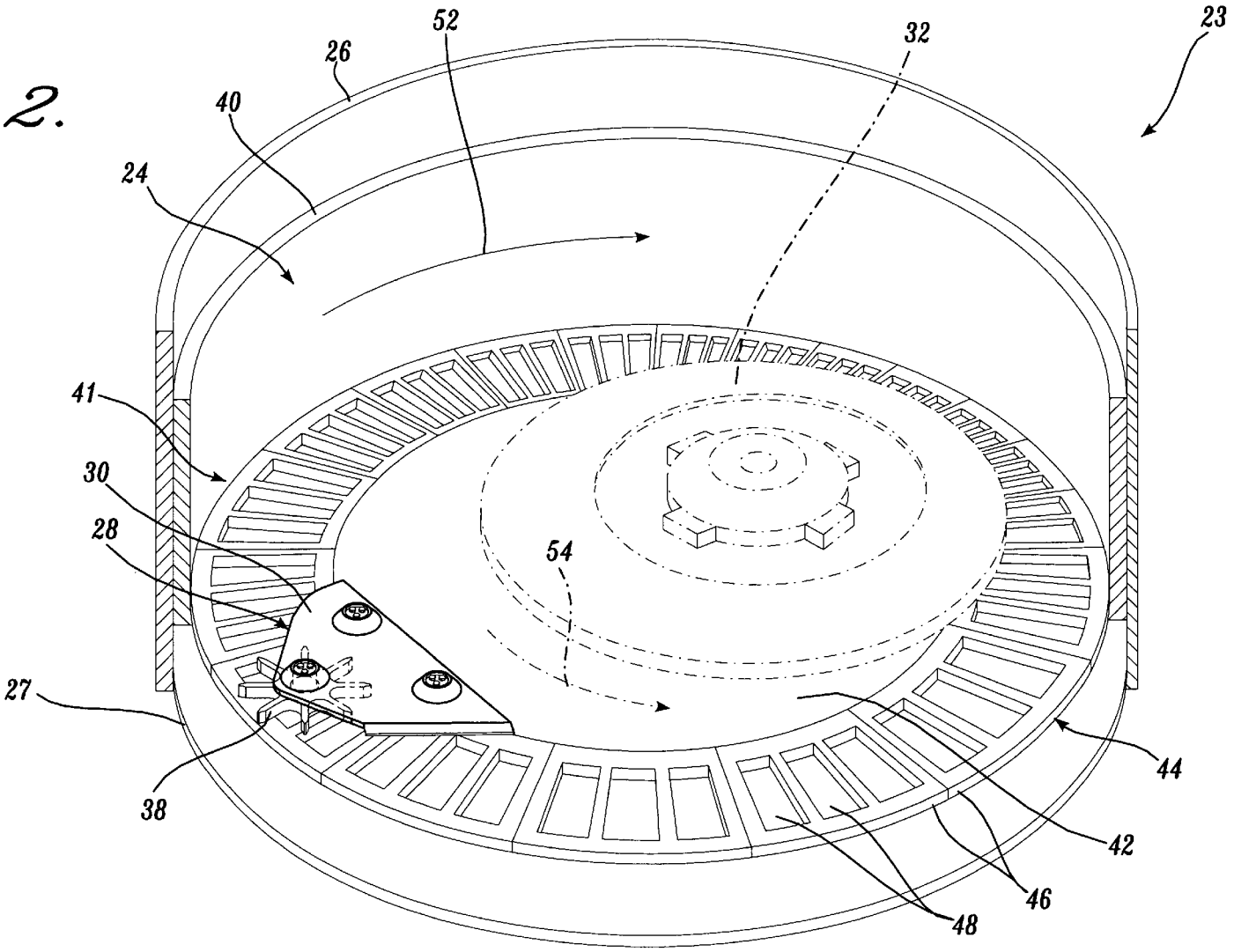
FIG. 2 is a cutaway, perspective view of the comminuting chamber and attachment illustrated in FIG. 1.

A more detailed, cut-away view of the comminuting chamber illustrated in FIG. 1 is shown in FIG. 2. The comminuting chamber 24 includes a vertically disposed sidewall 40 that rotates within the outer cylindrical housing 26. The chamber 24 also includes a bottom 41 disposed orthogonally across an end of the sidewall 40. The outer cylindrical housing 26 remains stationary while the comminuting chamber sidewall 40 rotates within the cylindrical housing 26.

In the embodiment illustrated in FIG. 2, the bottom 41 includes a center portion 42 and an annular portion 44 that surrounds the center portion 42. The annular portion 44 includes a screen defined by a series of grate segments 46 that lie on an underlying framework. The annular portion 44 preferably rotates together with the sidewall 40 in the comminutor illustrated, or alternately may remain stationary with the center portion 42. The grate segments 46 have a plurality of holes 48 formed in them and provide a screening function. Exit holes for comminuted material may also be defined at other locations within the chamber. The size of the holes 48 formed in the grate segments 46 determines the particle size that will exit the chamber 24. If it is desired to change the size of the particles exiting the chamber, the grate segments 46 can be removed and replaced with other grate segments having holes of a different size or configuration. Below the grate segments, the comminuter housing 26 includes an exit hole (not shown) that collects and allows the particles to exit the comminuter tub 23 onto a conveyor.

As indicated earlier, the comminuting action of the comminuter is provided by rotating both the chamber sidewall 40 and the toothed disk 32 mounted in the chamber. For purposes of simplicity, the teeth on the disk 32 are not shown. However, a toothed disk suitable for use in the invention is shown and described in U.S. Pat. No. 5,379,951, incorporated by reference herein. A plurality of cutting teeth are secured at spaced intervals about the periphery of the disk, and project radially outwardly or upwardly therefrom at various angles. Preferably, the chamber sidewall 40 rotates in a first direction, illustrated by arrow 52, while the toothed disk rotates in a second, opposite direction, illustrated by arrow 54. The rotating sidewall 24 imparts rotational motion to material 22 introduced into the comminuting chamber. When the material 22 comes into contact with the rotating toothed disk 32, the teeth on the disk impact material and thereby rip and shred the material into a particulate form.

An attachment 28 is mounted within the comminuting chamber to engage and reorient the material that is being comminuted. The embodiment of the attachment illustrated in FIG. 2 comprises a mounting plate 30 mounted on the stationary center portion 42 of the bottom of the chamber. The mounting plate extends horizontally in a plane adjacent to the bottom 41 of the chamber. As shown, the mounting plate also extends toward the sidewall 40 of the comminuting chamber adjacent the annular screen 44. The mounting plate 30 is suitably cut from steel plate.

Figure 3:
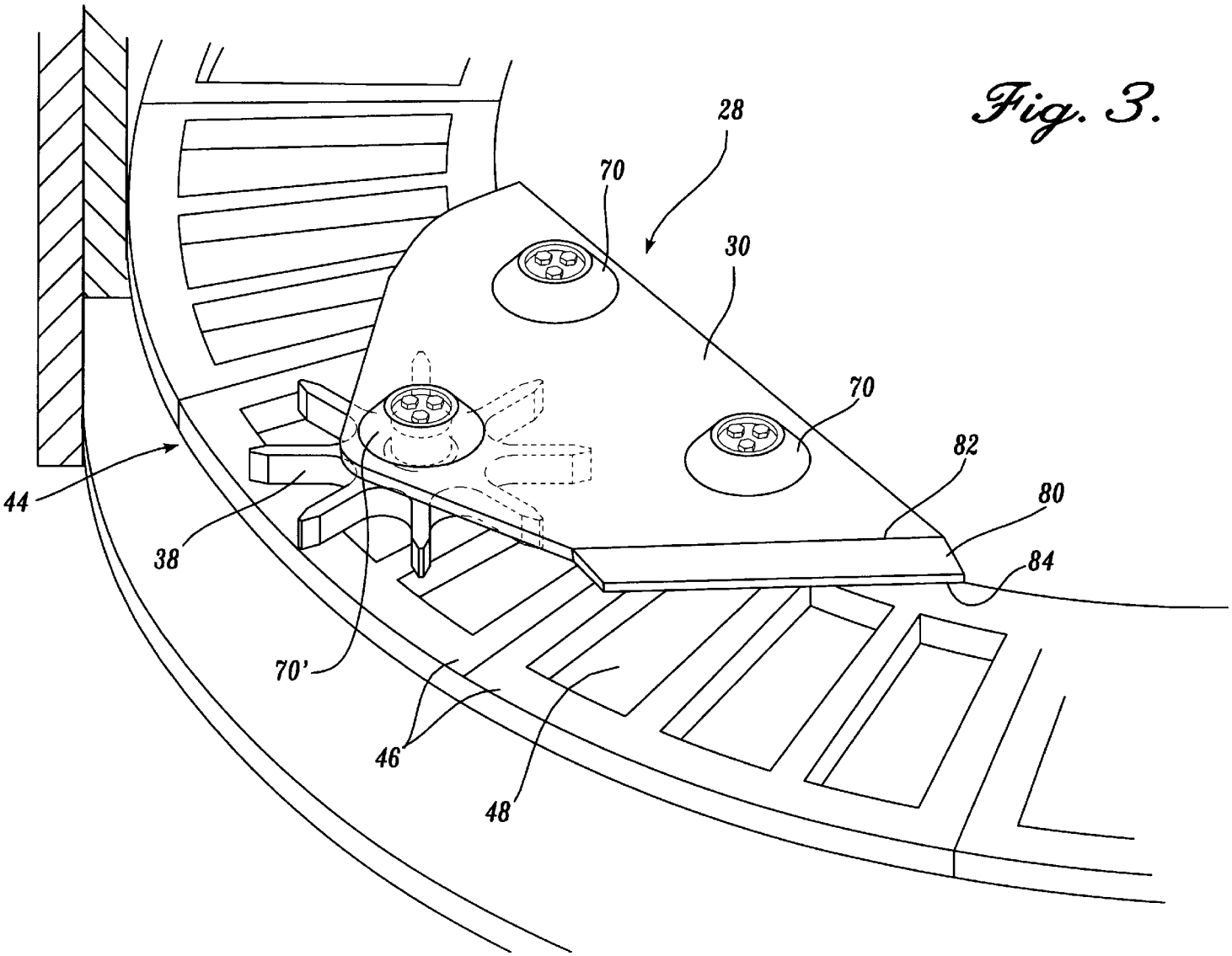
FIG. 3 is a detailed perspective view of the attachment illustrated in FIG. 2 including a plate with a flange and a scrubber.
Figure 4:
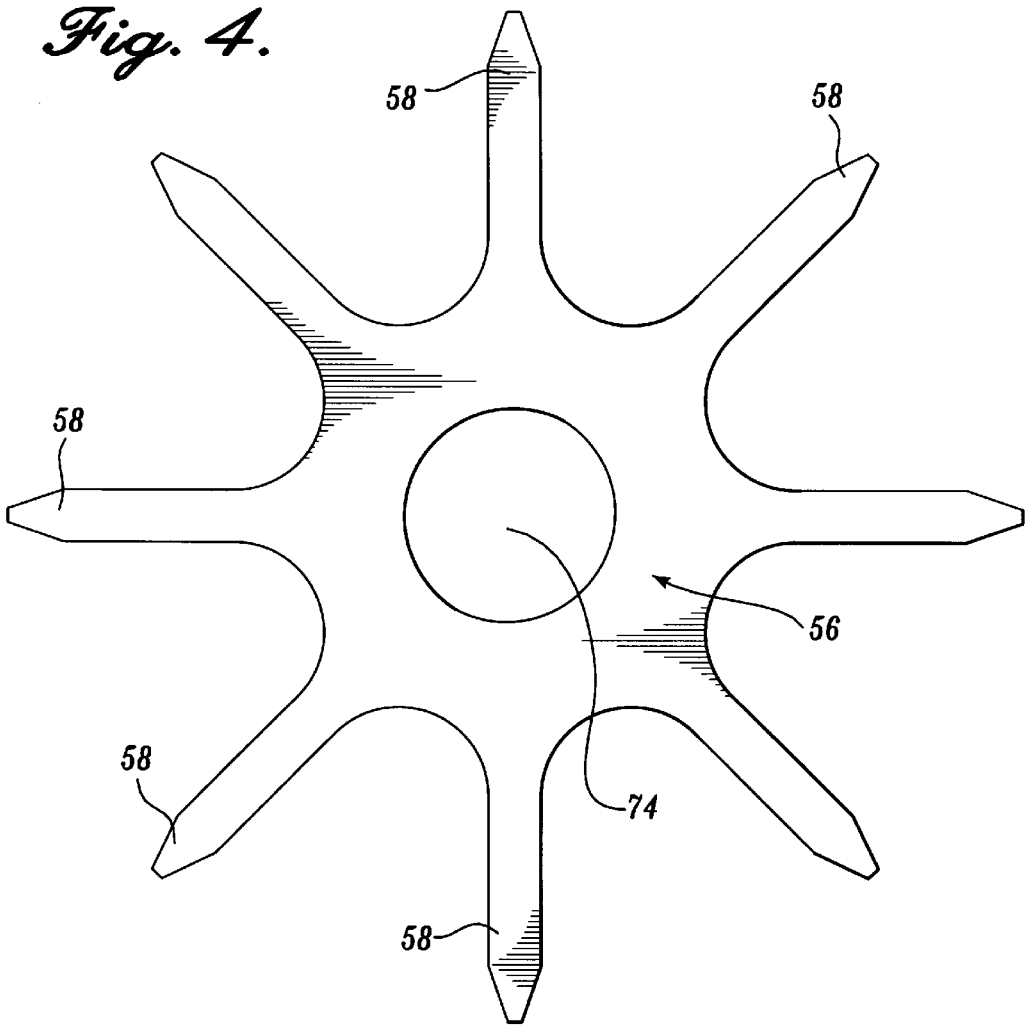
FIG. 4 is a plan view of the scrubber attachment of FIG. 2.

The attachment 28 illustrated in FIG. 2 further includes a scrubber 38 rotatably journaled on the mounting plate. The combined mounting plate 30 and scrubber 38 illustrated in FIG. 2 is shown in greater detail in FIGS. 3–5. In FIG. 3, it can be seen that the scrubber 38 is disposed between the grate segments 46 and the mounting plate 30. The mounting plate 30 serves as a cantilever mounting to position the scrubber 38 centrally over the width of the grate segments 46. A plan view of the scrubber is shown in FIG. 4. The scrubber has a hub 56 and a plurality of arms 58 connected to the hub. The arms 58 extend outward from the hub 56 in a radial direction. In a preferred embodiment, the scrubber 38 is flame cut from a 2-inch steel plate. The arms 58 have a predetermined width such that the total diameter of the scrubber 38 is substantially the same or slightly greater than the radial width of the holes 48 in the grate segments 46. The longitudinal thickness of the scrubber 38 is substantially the same, but slightly less, than the distance between the underside of the mounting plate 30 and the grate segments 46, to prevent material from being lodged therebetween. While the arms 58 are shown having a straight form, it is appreciated that the radially extending arms may alternately be bent or curved. Still further alternately, the scrubber 38 can be replaced with a flat, round rotary scrubbing disk, potentially with a beveled and sharpened cutting edge for some applications.

Figure 5:
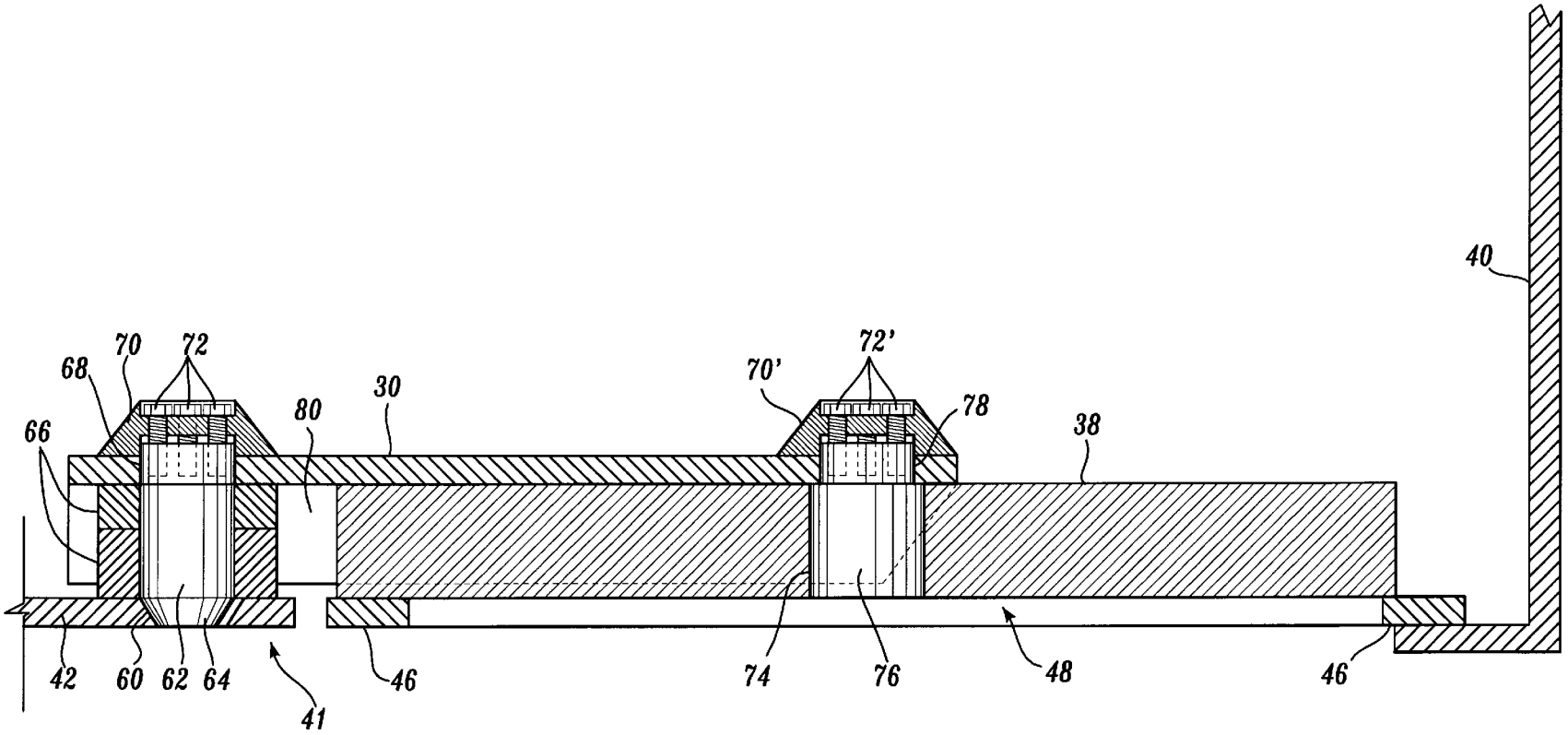
FIG. 5 is a diametric cross sectional view of the attachment illustrated in FIG. 3.

A sectional side view of the attachment shown in FIG. 3 is illustrated in FIG. 5 and shows the interconnection between the scrubber 38 and the mounting plate 30. FIG. 5 also illustrates the interconnection between the mounting plate 30 and the center portion 42 of the bottom 41 of the comminuting chamber. As illustrated, a hole 60 is defined in the center portion 42. A first mounting shaft 62 has a lower end 64 that is beveled. When the first mounting shaft 62 is received in the center portion hole 60, the mounting shaft 62 is welded in place to form a permanent connection with the center portion 42.

Shims 66 having a ring shape are placed on the first mounting shaft 62 by passing the mounting shaft through a center hole in the shims. The number, thickness and angularity of the shims 66 may vary, thereby providing flexibility in determining the height and angle at which the mounting plate 30 is spaced from the bottom 41. In FIG. 5, two shims 66 having a constant thickness are mounted on the first mounting shaft 62. On top of the shims 66, the mounting plate 30 is mounted by passing the upper end of the first mounting shaft 62 through a hole 68 defined in the mounting plate 30. A frustoconical mounting cap 70 is placed over receives the upper end of the first mounting shaft 62. Mounting bolts 72 are screwed through the mounting cap 70 into the upper end of the first mounting shaft 62. In this manner, the mounting plate 30 is secured to the center portion 42.

The mounting cap 70 has sloped sides to deflect material being comminuted during the operation of the comminuter. Furthermore, the heads of the mounting bolts 72 are recessed within the mounting cap 70, thereby shielding the mounting bolt heads from impact by the material that is being comminuted.

As shown in FIG. 5, the mounting plate 30 extends over a grate segment 46 including a screen hole 48. Disposed between the mounting plate and the screen is the scrubber 38. One end of a second mounting shaft 76 is inserted through the central hole 74 in the hub 56 of the scrubber 38. The other end of the second mounting shaft 76 is inserted through a hole 78 in the mounting plate. A mounting cap 70' is placed over the end of the second mounting shaft 76 through which mounting bolts 72' are screwed into the second mounting shaft 76. In this manner, the second mounting shaft 76 is secured to the mounting plate 30. The second mounting shaft 76 serves as an axle, and the scrubber 38 freely rotates around the second mounting shaft. During operation, material that is being comminuted impinges on the scrubber 38, causing the scrubber 38 to rotate, resulting in agitation and reorientation of the material to prevent jamming, facilitate screening, and facilitate further cutting of the material. A more consistently sized product, with reduced fines, is produced.

Referring again to FIG. 3, a further aspect of an attachment 28 is shown. In this embodiment of the attachment 28, the mounting plate 30 has a flange 80 disposed along at least a portion of an edge 82 of the mounting plate. In the preferred embodiment illustrated, the edge 82 is the leading edge of the mounted plate 30, i.e., the edge which material first impinges due to the rotation of the sidewall 40. The flange 80 extends angularly outward and downward toward the bottom of the comminuting chamber. Preferably, the bottom edge 84 of the flange 80 is maintained in close proximity to the bottom of the chamber that, in this case, includes the screen 44. As the material 22 that is being comminuted comes in contact with the mounting plate 30 and the flange 80, the flange provides upward direction to the material. Accordingly, the flange 80 acts in a manner to nearly scrape the bottom of the chamber and assist in the agitation and reorientation of the material 22. The flange 80 also prevents material from being swept under the plate 20 and impinging the wrong side of the scrubber 38. As a consequence, the reoriented material will more subsequently likely encounter the rotating toothed disk for further comminution, or pass through the screen 44 if sufficiently reduced in size. In some applications, it may be advantageous to bevel the lower edge 84 of the flange. The flanged mounting plate 30 and rotary scrubber 38 work in tandem, facilitating reorientation of material. However, it should be apparent that either the scrubber 38 could be eliminated, and partial effectiveness would still result within the scope of the present invention. A second flange may also be mounted on the opposite trailing edge of the mounting plate to accommodate reversal of the direction of rotation of the sidewall 40.

Figure 6:
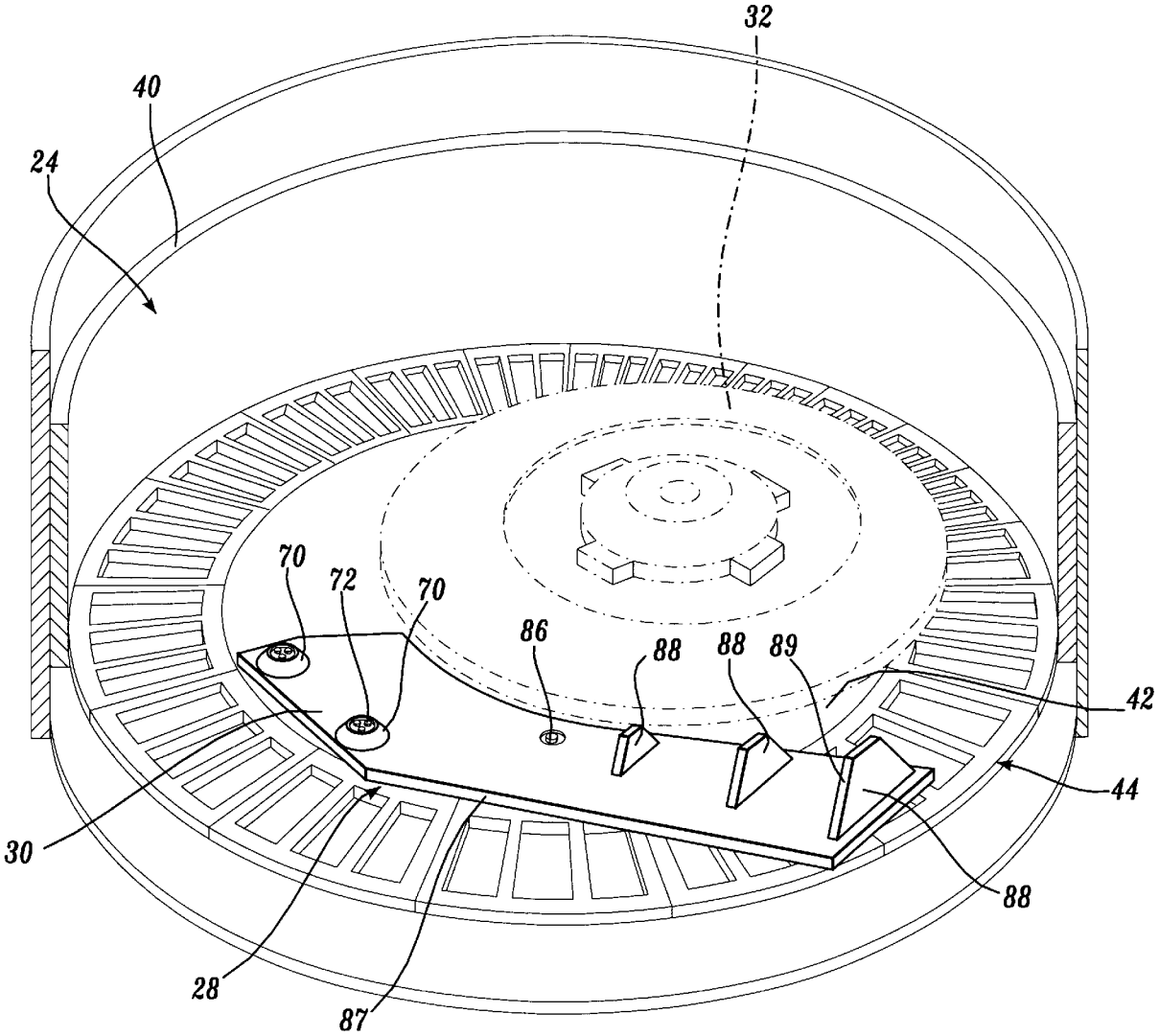
FIG. 6 is a perspective view of an alternate embodiment of a comminuting chamber and attachment including a plate with riser plate members constructed in accordance with the present invention.

Another embodiment of a comminuting chamber and an attachment therefor constructed according to the invention is illustrated in FIG. 6. Similar to the embodiment shown in FIGS. 2–5, the comminuting chamber 24 has a rotatable sidewall 40 and a bottom comprised of a center portion 42 and a screen 44. Within the chamber 24, a rotatably mounted toothed disk 32 and an attachment 28 are disposed. The attachment 28 includes a mounting plate 30 mounted to the center portion 42 by mounting bolts 72 in mounting caps 70. An additional bolt 86 may be used to further secure the mounting plate 30 to the center portion 42. The mounting plate 30 includes an extension portion 87 that extends tangentially across a plurality of openings in the screen 44.

In the embodiment of the attachment 28 shown in FIG. 6, a plurality of riser plate members 88 are attached to the mounting plate 30. Although three riser plate members are illustrated, it is appreciated that any number of riser plate members 88 may be used. The riser plate members 88 are attached, preferably by welding, to the mounting plate 30 to project upward away from the comminuting chamber bottom. The riser plate members 88 are preferably shaped with sides 89 that angle upwards. As the chamber sidewall 40 rotates and imparts rotational motion to the material 22 (FIG. 1) being comminuted, the material comes into contact with the mounting plate 30 and the riser plate members 88. As the material 22 passes over the riser plate members 88, the material 22 encounters the sloped edges 89 of the riser plate members and is forced to travel in an upward direction. In this fashion, the riser plate members engage and reorient the material being comminuted. If the mounting plate 30 is shaped such that the riser plate members 88 are in close proximity to the rotating toothed disk 32, the riser plate members 88 cause the material to travel upward and onto the rotating toothed disk. The riser plate members 88 serve to prevent material 22 from remaining near the bottom of the chamber 24 where it may avoid the toothed disk 32. By forcing the material up and onto the toothed disk, the riser plate members also help prevent material from lodging between the toothed disk 32 and the chamber sidewall 40, and in the reverse mode prevents violent jamming of the comminuter.

Figure 7:
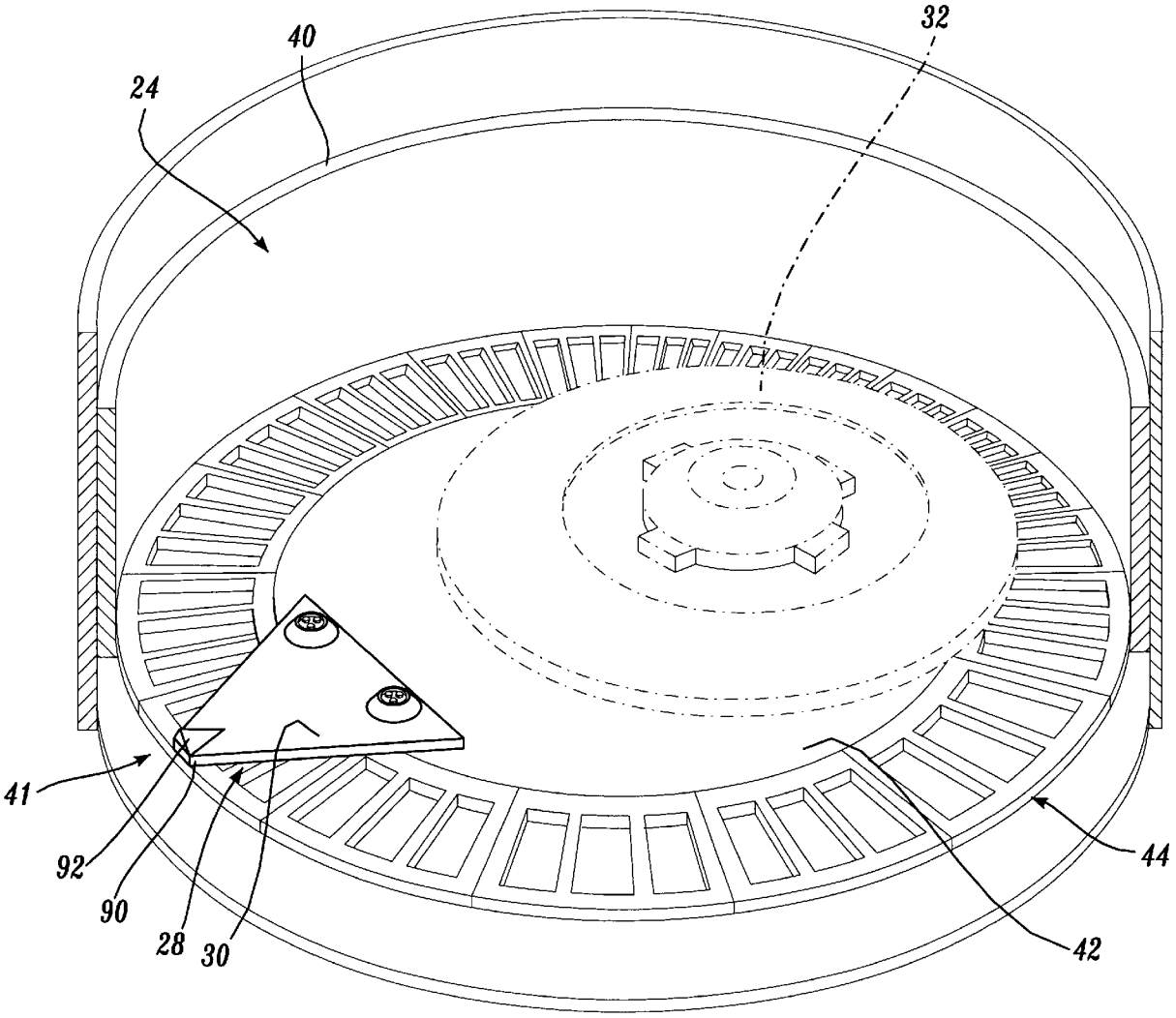
FIG. 7 is a perspective view of a comminuting chamber and alternate attachment including a plate with scraper plates made according to the invention.

Although not illustrated, it is appreciated that the attachment 28 shown in FIG. 6 may also include a scrubber rotatably engaged with the mounting plate 30 similar to the scrubber 38 shown in FIG. 3. Likewise, the attachment 28 may include a scraper plate 92 as illustrated in FIG. 7 and described in greater detail below. Furthermore, the leading or trailing edge of the extension portion 87 of the mounting plate 30 may be beveled or may include a flange similar to the flange 80 shown in FIG. 3.

Another comminuting chamber 24 and attachment 28 therefor constructed in accordance with the invention is illustrated in FIG. 7. Again, similar to the embodiments shown in FIGS. 2–6, the comminuting chamber 24 has a rotating sidewall 40 and toothed disk 32. The bottom 41 of the chamber 24 is comprised of a center portion 42 and a screen 44. The attachment includes a mounting plate 30 secured to the center portion 42. In this embodiment of the attachment 28, the mounting plate 30 extends outward to have an edge 90 disposed closely adjacent the rotating sidewall 40. Attached to the mounting plate 30 near the edge 90 is at least one scraper plate 92 projecting away from the mounting plate. In the preferred embodiment illustrated, three scraper plates 92 are welded to the mounting plate 30 and project upwards from the mounting plate. Each of the scraper plates 92 are mounted at an angle to have an upward slope. Moreover, the three scraper plates slope into each other, thus sharing a common edge. In this fashion, the three scraper plates form a structure that appears similar to a half of a pyramid. As the sidewall 40 rotates past the scraper plates 92, the scraper plates 92 scrape material from the sidewall 40 that has collected and/or adhered to the sidewall. This material may include soil that accompanied tree stumps introduced into the comminuting chamber, as well as wet comminuted material that has adhered to the rotating sidewall 40. Once scraped off the sidewall 40, if the material is small enough, it may fall to the bottom and pass through the screen 44 out of the chamber 24.

Figure 8:
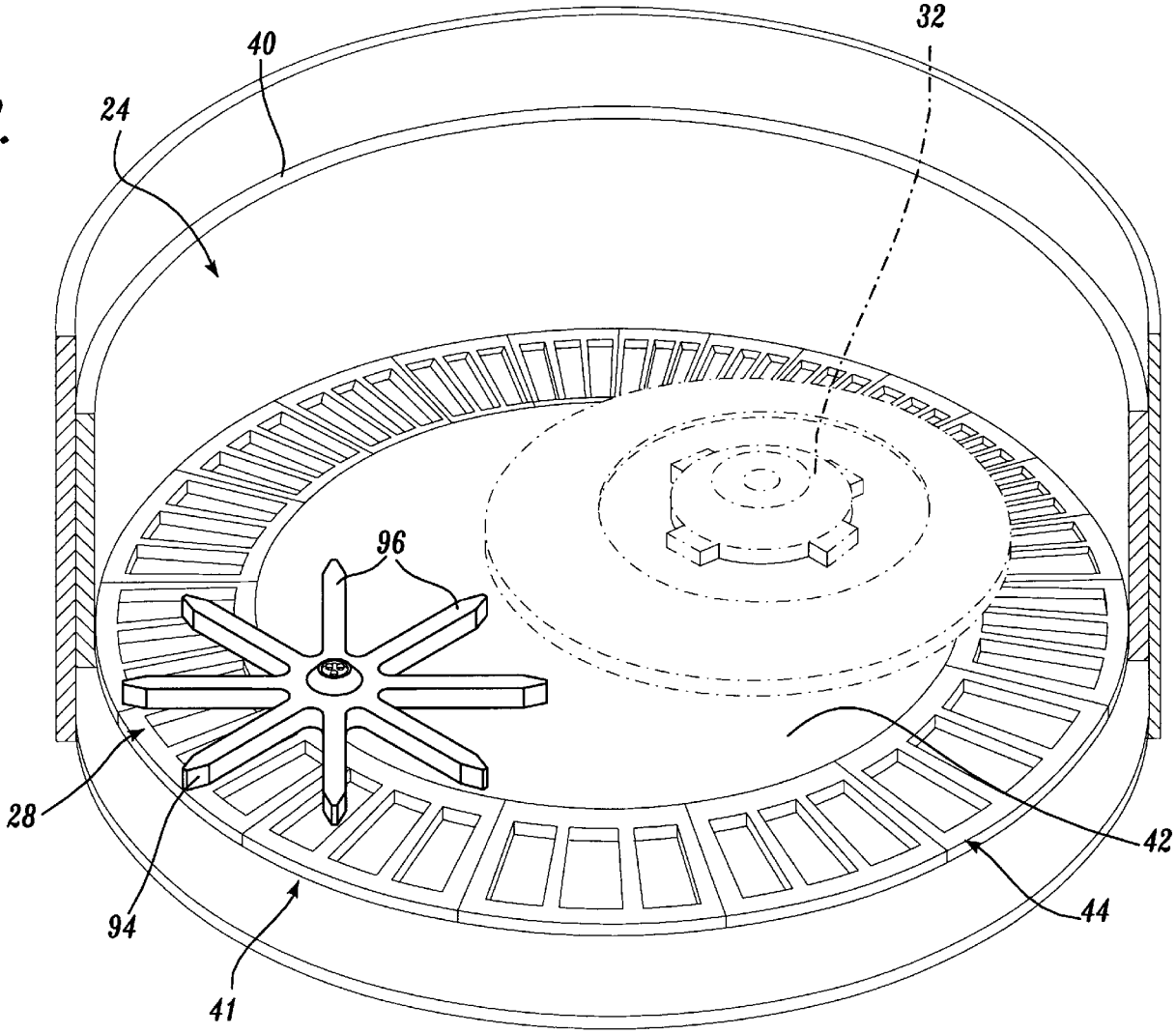
FIG. 8 is a perspective view of a comminuting chamber and alternate attachment comprising a large scrubber made according to the invention.

FIG. 8 illustrates yet another embodiment of a comminuting chamber and attachment therefor constructed in accordance with the invention. Again, the comminuting chamber 24 has a rotating sidewall 40 and a bottom 41 comprised of a center portion 42 and an annular screen 44. In this embodiment, the comminuting chamber 24 includes an attachment 28 shaped similar to the scrubber 38 shown in FIG. 2. In this instance, the attachment 28 is a large scrubber 94 with radially extending arms 96. The arms 96 are sized to extend substantially across the radial width of the screen 44 from the center portion 42 to the sidewall 40.

The scrubber 94 is rotatably attached to the center portion 42 via a mounting cap and mounting shaft arrangement similar to the structure described in reference to FIGS. 3 and 5. A mounting shaft (hidden in FIG. 8) extends from the center portion 42 through a hole defined in the scrubber 94 into the mounting cap. The mounting cap is secured to the mounting shaft by bolts. The scrubber 94 is then free to rotate about an axis defined by the mounting shaft.

As the scrubber 94 freely rotates (or alternately is powered by a drive mechanism (not shown)), the arms 96 of the scrubber engage and reorient the material in the comminuting chamber 24 that is being comminuted. The scrubber 94 thus assists in preventing semi-comminuted material from collecting on the bottom 41 of the chamber and clogging up the screen 44. The scrubber 94 also assists in reorienting the material so it may better engage the rotating toothed disk 32 for comminution.

Depending on the configuration of the comminuting chamber 24, the toothed disk 32 is sized such that it does not interfere with the rotation of the scrubber 94. Because the arms 96 of the scrubber 94 illustrated in FIG. 8 extend substantially across the radial width of the screen, and because the scrubber 94 is rotatably mounted to the center portion 42, the scrubber 94 occupies a larger space. Accordingly, the toothed disk 32 is smaller in diameter as compared to the toothed disks illustrated heretofore. However, the comminuting action provided by the toothed disk 32 and the rotating sidewall 40 remains the same.

As a summary, it is appreciated from the discussion above that the comminuting chamber and attachments therefor constructed in accordance with the principles of the invention may take form in a variety of embodiments. The comminuting chamber may include an attachment that comprises a plate secured to the bottom of the comminuting chamber. In this embodiment, the plate extends horizontally in a plane adjacent to the bottom of the chamber. As material to be comminuted is introduced into the chamber and moves around within the chamber, the plate is disposed such that an edge of the plate engages and reorients the material in the chamber. In one aspect, the edge provides an obstacle for material to pass over. In another aspect, the edge may be beveled to provide direction to the material as it engages the plate. In any event, as the material engages and passes over the plate, the material is reoriented into a position that encourages more efficient comminution.

In a further embodiment of the invention, a scrubber may be rotatably mounted on the mounting plate. The scrubber has a hub and a plurality of arms that extend radially outward from the hub. See FIG. 4. In FIGS. 2–5, the scrubber is shown disposed between the mounting plate and the bottom of the chamber. By adding a scrubber to the mounting plate in this fashion, the scrubber provides an additional rotating obstacle which serves to engage and reorient the material being comminuted. Furthermore, if the scrubber is mounted between the plate and the bottom of the chamber such that the scrubber rides on the chamber bottom, the rotation of the scrubber provides a scraping action on the bottom of the chamber as the material passes by the scrubber.

Figure 9:
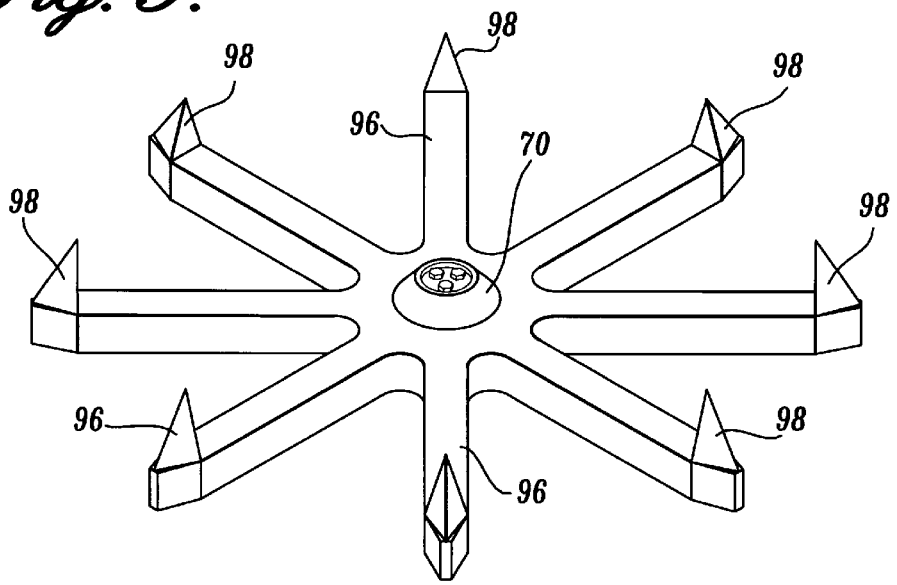
FIG. 9 is a perspective view of an alternate attachment comprising a scrubber with barbs extending upwardly from the arms of the scrubber.

In another embodiment of the invention, the comminuting chamber is equipped with an attachment that is a scrubber alone, as shown in FIG. 8. As noted earlier, in such an embodiment, the diameter of the toothed disk may be reduced to accommodate the size of the scrubber. As a further aspect of the embodiment shown in FIG. 8, the arms 96 of the scrubber 94 may be equipped with barbs 98, as shown in FIG. 9. The barbs 98 may be attached to any one or all of the arms 96 of the scrubber 94 at any location along the length of the arms 96. In FIG. 9, the barbs are shown attached to the upper surface and at the end of all of the arms 96. Preferably, the barbs 98 extend upward into the comminuting chamber. Furthermore, the barbs may be pointed as shown, or have blunt or rounded edges. The barbs provide an additional surface for engaging and reorienting the material as it passes over the attachment.

In yet a further embodiment of the invention where the attachment includes a mounting plate, the mounting plate may include a flange extending outward and downward from the mounting plate toward the bottom of the chamber. Material lying on the bottom of the chamber will engage the flange and be forced to travel in an upward direction. Accordingly, the flange adds another surface to the mounting plate which engages and reorients the comminuted material.

An attachment having a mounting plate may also include riser plate members attached to the mounting plate that extend upward into the comminuting chamber, as shown in FIG. 6. Preferably, the riser plate members have an angled edge that provides an upward direction to the material being comminuted as it passes over the riser plate members. The riser plate members may also act in a manner to comb the material being comminuted. Again, the riser plate members add additional surfaces to the attachment which engage and reorient the comminuted material.

In yet another embodiment of the invention, an attachment including the mounting plate may further include scraper plates extending upward into the chamber. The scraper plates are disposed at an edge of the mounted plate adjacent the chamber sidewall. The scraper plates engage and remove material that has collected on the chamber sidewall as the sidewall rotates past the scraper plates.

In alternate embodiments of the invention (not shown), the riser plates or scraper plates could be mounted directly to the screen portion of the bottom of the chamber, without a mounting plate, for machines in which the screen platform is not rotating.

Figure 10:
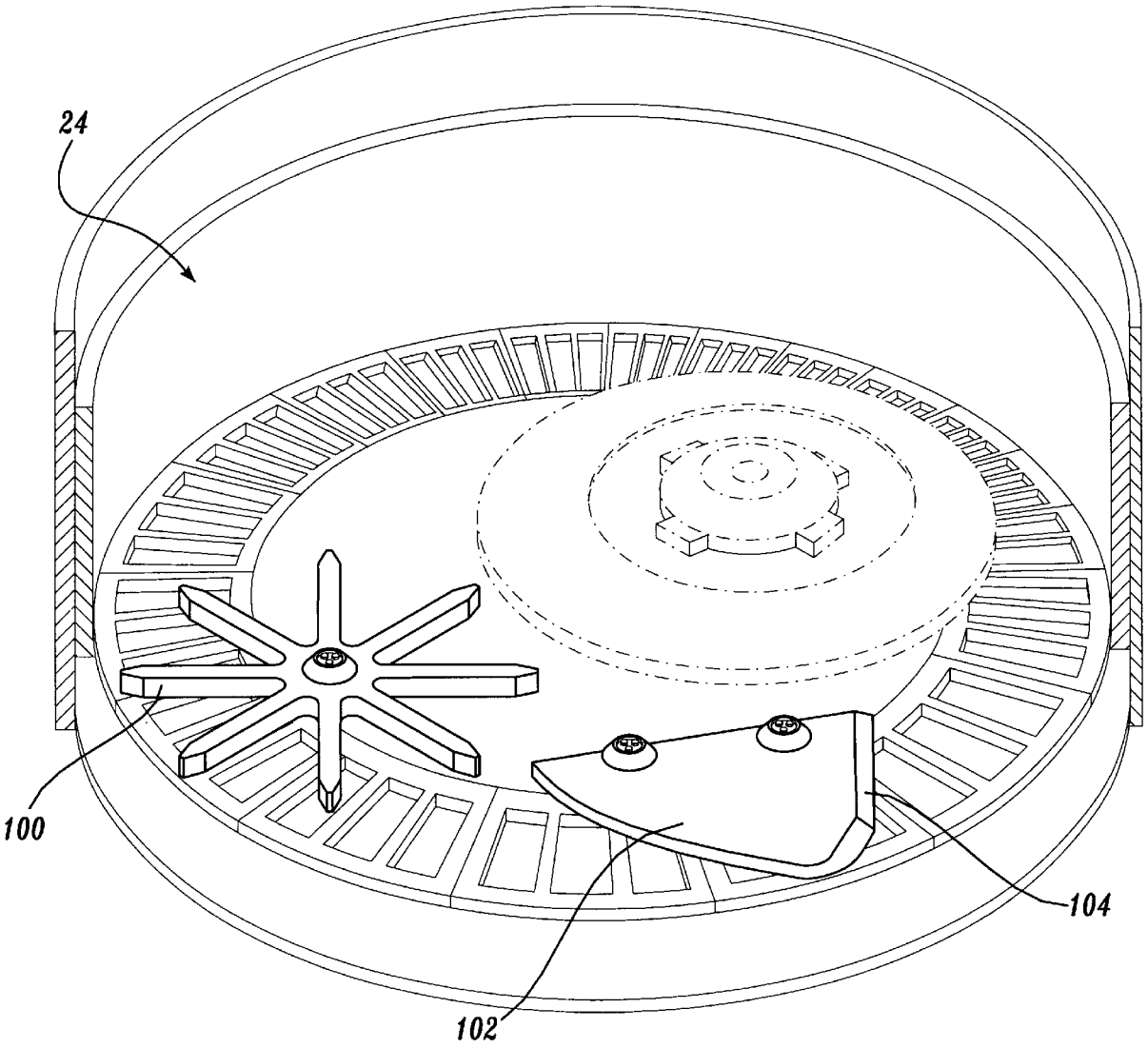
FIG. 10 is a perspective view of a comminuting chamber having multiple attachments mounted therein constructed in accordance with the invention.

It should also be appreciated that the invention is not limited to a comminuting chamber with a single attachment. In some circumstances, it may be advantageous to secure two or more attachments to the bottom of the chamber. The attachments may be embodied in any of the forms described above, e.g., a plate alone, a plate with a rotatably engaged scrubber, a scrubber alone rotatably engaged to the bottom, a scrubber with barbs extending upward into the chamber, a plate with a downward extending flange, and a plate with riser plate members extending upward into the chamber. In FIG. 10, a comminuting chamber 24 is shown having two attachments constructed in accordance with the invention. One attachment is a scrubber 100. The other attachment is a plate 102. The plate 102 further has a beveled edge 104 angled outward and downward from the top of the plate to the bottom of the chamber.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A comminuting chamber in which solid material is reduced to a particulate form, comprising:

a rotatable sidewall;

a bottom disposed across an end of the sidewall and defining an outlet screen for the discharge of comminuted material;

a toothed disk rotatably mounted within the chamber adjacent the bottom;

an attachment mounted within the chamber and adjacent the bottom to extend across the entire width of the outlet screen for engaging and agitating material that is being comminuted.

2. A comminuting chamber according to claim 1, wherein the attachment comprises a plate secured in the chamber to said bottom, the plate extending in a plane adjacent the bottom.

3. A comminuting chamber according to claim 2, wherein the plate further comprises at least one riser plate member secured to the plate, the riser plate member projecting upward into the chamber away from the bottom for engaging the material that is being comminuted and causing the material to travel in an upward direction when the material passes over the riser plate member.

4. A comminuting chamber according to claim 1, the bottom further defining a screen through which comminuted material may exit the chamber, wherein the attachment comprises a scrubber rotatably mounted in the chamber, the scrubber having a hub and a plurality of radially extending arms.

5. A comminuting chamber in which solid material is reduced to a particulate form, comprising:

a rotatable sidewall;

a bottom disposed across an end of the sidewall and defining an outlet screen for the discharge of comminuted material;

a toothed disk rotatably mounted within the chamber adjacent the bottom;

an attachment mounted within the chamber and adjacent the bottom to extend substantially across a width of the outlet screen for engaging and agitating material that is being comminuted, wherein the attachment comprises a plate secured in the chamber to said bottom, the plate extending in a plane adjacent the bottom, and wherein the plate further comprises a flange extending along at least a portion of an edge of the plate, wherein the flange extends outward and downward from the edge toward the bottom.

6. A comminuting chamber in which solid material is reduced to a particulate form, comprising:

a rotatable sidewall;

a bottom disposed across an end of the sidewall and defining an outlet screen for the discharge of comminuted material;

a toothed disk rotatably mounted within the chamber adjacent the bottom;

an attachment mounted within the chamber and adjacent the bottom to extend substantially across a width of the outlet screen for engaging and agitating material that is being comminuted, wherein the attachment comprises a plate secured in the chamber to said bottom, the plate extending in a plane adjacent the bottom, and wherein the plate has an edge disposed adjacent the sidewall and wherein the plate further comprises at least one scraping plate member secured to the plate near the edge, the scraping plate member projecting away from the plate, for engaging and scraping material in the chamber disposed against the sidewall.

7. A comminuting chamber in which solid material is reduced to a particulate form, comprising:

a rotatable sidewall;

a bottom disposed across an end of the sidewall and defining an outlet screen for the discharge of comminuted material;

a toothed disk rotatably mounted within the chamber adjacent the bottom;

an attachment mounted within the chamber and adjacent the bottom to extend substantially across a width of the outlet screen for engaging and agitating material that is being comminuted, wherein the attachment comprises a plate secured in the chamber to said bottom, the plate extending in a plane adjacent the bottom, and wherein the attachment comprises a scrubber rotatably engaged with the plate, the scrubber having a hub and a plurality of radially extending arms.

8. A comminuting chamber according to claim 7, wherein the plate extends in a plane spaced above the bottom and the scrubber is disposed between the bottom and the plate.

9. A comminuting chamber in which solid material is reduced to a particulate form, comprising:

a rotatable sidewall;

a bottom disposed across an end of the sidewall;

a toothed disk rotatably mounted in the chamber adjacent the bottom;

a mounting plate secured in the chamber in a horizontal plane adjacent the bottom; and a scrubber rotatably engaged with the mounting plate, the scrubber having a hub and a plurality of arms extending radially from the hub.

10. A comminuting chamber according to claim 9, wherein the bottom has an exit aperture defined therein, and at least one of the mounting plate and the scrubber extends at least partially over the exit aperture.

11. A comminuting chamber according to claim 10, wherein the exit aperture is defined adjacent the rotatable sidewall, and at least one of the mounting plate and the scrubber approach the sidewall.

12. A comminuting chamber according to claim 11, wherein the scrubber spans the width of the exit aperture.

13. A comminuting chamber according to claim 9, wherein the mounting plate extends in a plane spaced above the bottom and the scrubber is disposed between the bottom and the mounting plate.

14. A comminuting chamber according to claim 13, wherein the mounting plate further comprises a flange extending along at least a portion of an edge of the mounting plate, the flange extending outward and downward from the edge toward the bottom to at least partially shield the scrubber.

15. A comminuting chamber according to claim 9, wherein a shim is selectively disposed between the mounting plate and the bottom at a point where the mounting plate is secured to the bottom to adjust the orientation of the mounting plate relative to the bottom.

16. A comminuting chamber in which solid material is reduced to a particulate form, comprising:

a rotatable sidewall;

a bottom disposed across an end of the sidewall, the bottom having a screen through which comminuted material may exit the chamber;

a toothed disk rotatably mounted in the chamber adjacent the bottom; and a plate secured in the chamber in a horizontal plane spaced above the bottom, wherein the plate overlaps at least a portion of the screen and wherein a first edge of the plate engages and reorients material in the chamber that is being comminuted.

17. A comminuting chamber according to claim 16, wherein the plate has a flange extending along at least a portion of the first edge, the flange extending outward and downward from the first edge toward the bottom.

18. A comminuting chamber according to claim 16, wherein at least one riser plate member is secured to the plate, the riser plate member projecting upward into the chamber away from the bottom for engaging material that is being comminuted and causing the material to travel in an upward direction when the material passes over the riser plate member.

19. A comminuting chamber according to claim 16, wherein the plate has a second edge disposed adjacent the rotatable sidewall and wherein a scraping plate member is secured to the plate at the second edge, the scraping plate member projecting away from the plate, for engaging and scraping material in the chamber disposed against the sidewall.

20. A comminuting chamber in which solid material is reduced to a particulate form, comprising:

a rotatable sidewall;

a bottom disposed across an end of the sidewall, the bottom having a screen through which comminuted material may exit the chamber;

a toothed disk rotatably mounted in the chamber adjacent the bottom; and a scrubber rotatably mounted in the chamber adjacent the bottom, the scrubber having a hub and a plurality of arms connected to the hub, wherein each arm of the plurality of arms extends radially outward from the hub and substantially across the width of the screen.

21. A comminuting chamber according to claim 20, wherein a barb is attached to at least one arm in the plurality of arms, the barb projecting upward into the chamber.

22. A comminuting chamber according to claim 20, wherein the scrubber is rotatably mounted to the bottom of the chamber.

23. A comminuting chamber in which solid material is reduced to a particulate form, comprising:

a rotatable sidewall;

a bottom disposed across an end of the sidewall;

a toothed disk rotatably mounted within the chamber adjacent the bottom; and a plate mounted on the bottom and disposed substantially adjacent the sidewall to scrape material in the chamber disposed against the sidewall, the plate extending at an at least partially vertical disposition above the bottom, thereby reorienting comminuted material as it flows along the sidewall.

24. A comminuting chamber according to claim 23, wherein the plate is a vertically disposed riser plate having an angled leading edge on which comminuted material impinges.

25. A comminuting chamber according to claim 23, wherein the plate is a scraper plate disposed adjacent the sidewall to scrape material in the chamber disposed against the sidewall.

* * * * *